United States Patent [19]

Baccanelli

[11] Patent Number: 4,751,433

[45] Date of Patent: Jun. 14, 1988

[54] DEVICE PERMITTING OF ECONOMIZING ELECTRIC LIGHTING ENERGY

[76] Inventor: Giuseppe Baccanelli, via Molinazzo, 6982 Agno, Switzerland

[21] Appl. No.: 384,659

[22] Filed: Jun. 3, 1982

[30] Foreign Application Priority Data

Jun. 5, 1981 [CH] Switzerland ..... 3693/81

[51] Int. Cl.[4] ..... H05B 37/02; H05B 39/04; H05B 41/36

[52] U.S. Cl. ..... 315/158; 250/227; 315/156; 315/194

[58] Field of Search ..... 315/156, 158, 194, 199, 315/291, DIG. 4; 250/227, 239

[56] References Cited

U.S. PATENT DOCUMENTS 3,401,265 9/1968 Dotto ..... 315/158 X
3,621,269 11/1971 Misencik ..... 250/227
4,234,820 11/1980 Widmayer ..... 315/158 X
4,368,406 1/1983 Kruzich et al. ..... 315/158

FOREIGN PATENT DOCUMENTS 2362225 6/1975 Fed. Rep. of Germany ..... 315/194
0070664 6/1979 Japan ..... 315/158

*Primary Examiner*—Saxfield Chatmon
*Attorney, Agent, or Firm*—Young & Thompson

[57] ABSTRACT

The device is to be mounted on any individual chandelier or any form of lamp: normal bulb (10), fluorescent, neon, sodium mercury vapor etc. When the space is not illuminated very much, the lamp (10) in consequence of the electronic circuit contained in the device according to the invention (1) lights up with an intensity so as to compensate for the reduction of the illumination of the surroundings.

The device therefore controls every individual lamp economizing energy because unlike the known devices controlling groups of lamps it acts so as to subdue the light emitted by the lamp or bulb gradually the more the space surrounding it is illuminated. The luminous energy emitted is inversely proportional to the luminous intensity of the surrounding space. The luminous energy of the space is preferably communicated to the device (1) by means of a bundle of optical fibres (2) avoiding the light reflected by the shield (14) of the lamp.

6 Claims, 2 Drawing Sheets

DEVICE PERMITTING OF ECONOMIZING ELECTRIC LIGHTING ENERGY

A problem which nowadays affects the individual citizen is the saving of energy. Everyone should make his contribution using energy more rationally and making the most of alternatives where possible.

A place which is over illuminated on a street or a garden illuminated when natural light is already sufficient does not help to save energy.

In the majority of cases a chandelier is constituted by several lamps not with the object of meeting actual demand for illumination but for a function which is purely aesthetic and attractive.

In the majority of cases, in public places, restaurants and hotels due to foregetfulness or negligence these chandeliers are always alight even when natural light would be sufficient and the energy which is wasted is enormous.

The device according to the present invention affords an effective contribution to the saving of electric energy.

Devices which connect and disconnect apparatus for illumination by means of photo-cells when the sunlight diminishes and increases respectively beyond a predetermined value are already known (see, for example, U.S. Pat. Nos. 4,023,035, 3,573,543; 3,450,030; 3,896,334; 3,543,088; and 3,517,259; German OS No. 1,945,267; and German OS No. 1,764,469).

These known devices however do not permit of subduing the light of a lamp or a group of lamps so that they emit light with a luminous intensity inversely proportional or almost inversely proportional to the intensity of the ambient light, which is contrary to the case of the device according to the invention. This latter is in addition extremely simple and can be installed even by an inexperienced person.

The most outstanding advantages are:

- it does not require adaptations, improvements or changes in the existing electrical installation;
- it is possible to mount it at all existing light points;
- every light point is set individually with the advantage of distributing the luminosity of the different light points taking into account the individual positions;
- it is very easy to assemble;
- the setting of the maximum degree of luminosity which it is desired to allot to the lamp is extremely simple, it does not require special tools such as screw-drivers etc.

The accompanying drawings show some preferred embodiments of the device in question.

Figure 1:
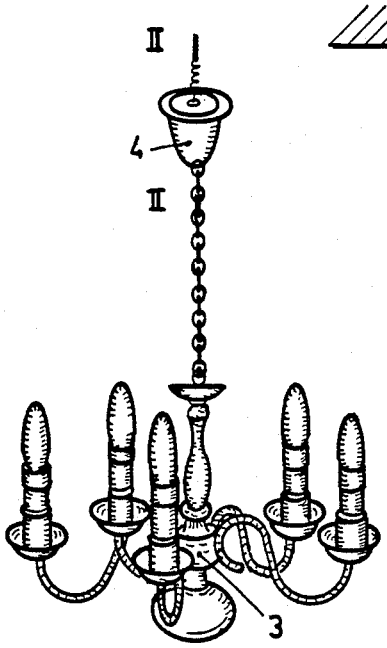
FIG. 1 shows the device applied to a chandelier.
Figure 2:
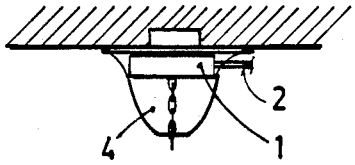
FIG. 2 shows the enlarged section in the plane passing through II—II of FIG. 1.

In FIG. 1 is illustrated a chandelier 3 in the rose 4 of which (see the section of FIG. 2) is inserted the device 1 according to the present invention from which device the bundle of optical fibres 2 projects which take and convey to the said device the light with the luminous intensity peculiar to the surroundings.

Figure 3:
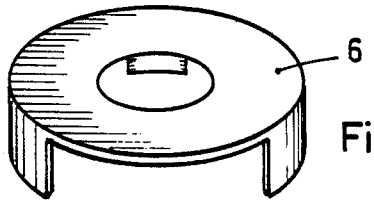
FIGS. 3, 4, 5 show in exploded view the components of the device of FIGS. 1 and 2.
Figure 4:
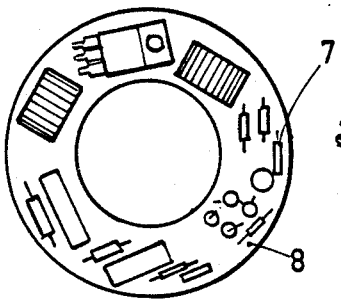
Figure 5:
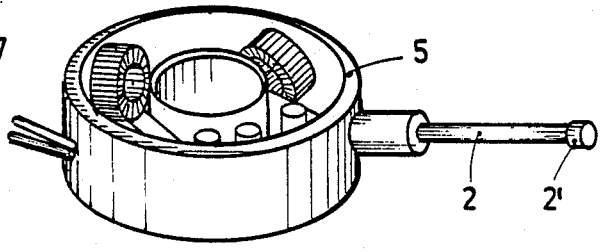

FIGS. 3, 4, 5 show the assembly of the device in question comprising a printed circuit 8 with the electronic components or the photo-electric cell 7, the bundle of optical fibres 2 with terminal 2', the holder 5, and the cover 6 mounted. The printed circuit 8 is mounted in the holder 5 and the photo-electric cell 7 is illuminated by means of the bundle of optical fibres 2. On the free end of the bundle of optical fibres is mounted a device (not shown) for regulating manually the light which the terminal receives, or a connector for optical fibres 2' so that the said bundle may be extended for the manual or automatic regulation at a distance from the desired luminous intensity.

Figure 6:
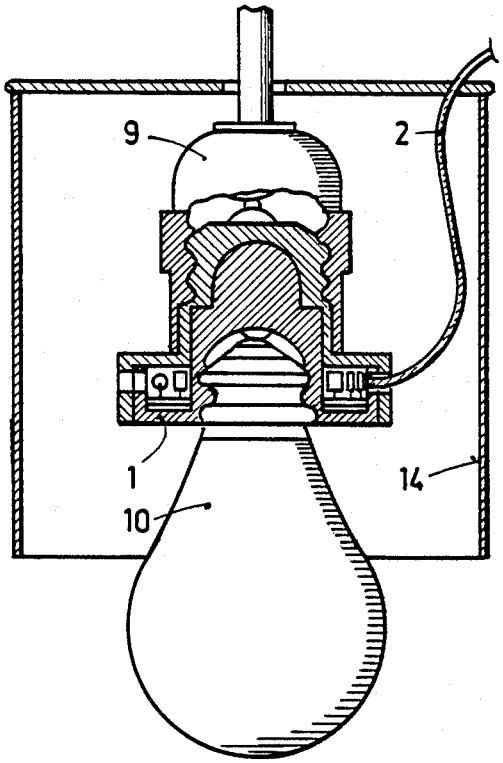
FIG. 6 shows in front view partly in section a second embodiment applied to the lamp holder of a conventional single lamp.
Figure 9:
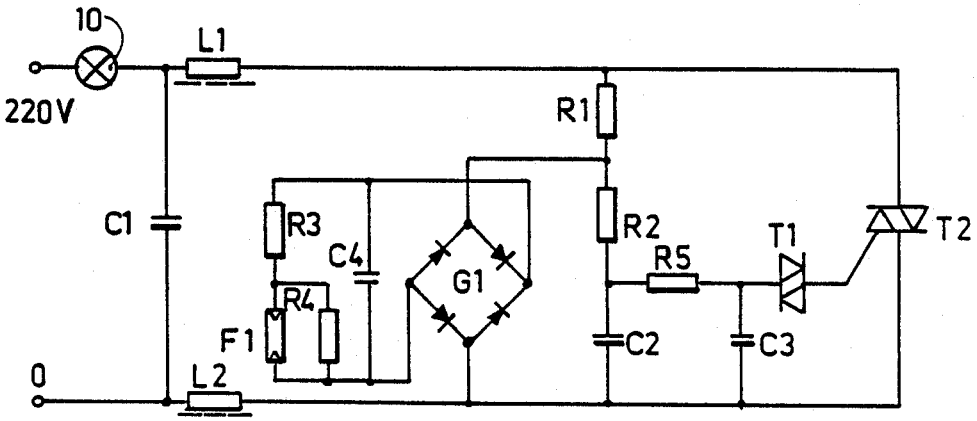
FIG. 9 shows the preferred electronic circuit diagram for realizing the device in question.

FIG. 6 shows one embodiment of the device for screwing into the existing lamp holder 9. The device is similar to an additional lamp holder which is screwed into the lamp holder 9 and receives in its turn by screwing, the bulb. On the inside is mounted the printed circuit with the associated components illustrated in FIG. 9.

The optical rod 2 (FIG. 6) takes light from the outside to avoid the photo-cell 7 receiving the light from the bulb reflected by the shield 14. Without the rod to the outside the bulb 10 would be extinguished immediately by its reflected light.

Figure 7:
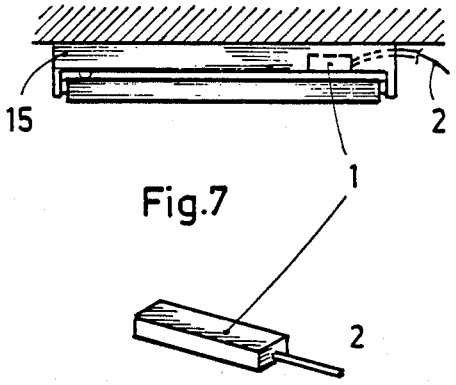
FIG. 7 shows the device in question applied to a tubular fluorescent lamp.

FIG. 7 shows the application of the device to fluorescent or neon lamps and for all types of street lamps etc. Electrically it is equal to the realization according to FIGS. 3, 4, 5 whilst the holder may vary from lamp to lamp and is adapted to the mechanical construction of the said lamp. It is a closed box 1 from which emerges the bundle of optical fibres 2 which receives light from outside.

Figure 8:
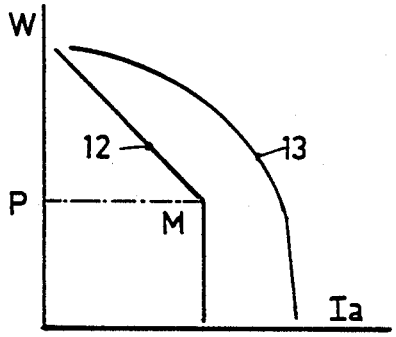
FIG. 8 shows the diagram of the power (W) absorbed by the lamp or by the group of lamps according to the luminous intensity "Ia" of the surroundings.

FIG. 8 shows the diagram according to two different preferred curves 12 and 13 of the power W absorbed from the lamp (ordinate) according to the luminous intensity of the surroundings Ia (abscissa). If the light of the surroundings increases the power W of the lamp decreases.

As can be seen from line 12 of the diagram, above a specific luminous intensity of the surroundings, the lamp (or the group of lamps) is extinguished completely and the power absorbed passes immediately from the point P to zero.

In the following are quoted a few examples of practical examples:

1. A place is illuminated by two 100 W bulbs to each of which is applied the device in question. Lighting one of the lamps consumes 100 W. Lighting also the second, if it is very close to the first there is not a double consumption 100 W+100 W, but somewhat less because each bulb takes into account that the other is lighted and therefore reduces by means of the device in question, its own luminous energy.

If an external source of light enters the place the electronic device of each lamp takes into account this new contribution and reduces therefore the electrical energy consumed. If the place is sufficiently illuminated from outside the lamps become almost extinguished.

2. A condominium of six floors has the illumination plant of the staircase connected to that of the cellar. If a person during the day goes down to the cellar to light the cellar lamp he has to light all the lamps of the staircase. With the device according to the invention applied to all the lamps only the cellar lamp is to be illuminated because it is in a dark place whilst those on the staircase do not light because the light entering from outside is sufficient.

3. A garden at the entrance of a house is illuminated by one or more lamps. When dawn breaks the lamp having more external light reduces gradually its own luminosity and therefore the consumption of energy, whilst that most concealed from the light maintains it.
4. Many children are afraid to sleep in the dark; with the device according to the present invention it is possible to adapt a degree of night luminosity for the bulb of the room thus consuming less energy.
5. A chandelier normally has many lamps, When all are alight the energy consumed is enormous. It is possible to unscrew some superfluous bulbs in order to consume less energy but aesthetically that is less attractive and creates a sense of hardship in front of visitors. With the device according to the invention all the bulbs remain alight but each one reduces its own energy so that the total energy does not become excessive.
6. For street lighting or in public places the applications are very varied.

The operation of the electronic circuit (FIG. 9) is as follows:

The condenser Cl with the coils L1 and L2 forms a filter for the disturbances caused by the triac during its lighting. The condenser C3 is charged through the resistance R1, R2 and R5. When the voltage at its ends reaches a value of about 30 V, the diac T1 connects the triac T2 and the lamp 10 lights up. By varying the charging current of the condenser C3 the voltage of 30 V at its end advances or retards the lighting of the triac. The lighting of the triac can vary within 180 degrees of the half-period of the alternating current. Displacing the point of lighting of the triac varies the power supplied to the lamp and consequently its degree of luminosity.

Lighting the triac at the beginning of 180 degrees the lamp receives the maximum power.

The electrical resistance of the photo-cell F1 when it is blacked out is very high above 10 Mohm; since the resistance R4 also has a high value the current which passes through R1 is almost equal to the current which passes through R2 and C3 is charged for a very short time. The luminosity of the lamp has under these conditions its maximum value. If the photocell is illuminated the value of its electrical resistance decreases and consequently more current circulates in it. The current which passes through the photocell is to be substracted from the charging current of the condenser C3 and the voltage at its ends increases more slowly and consequently the lighting of the triac is retarded. The bulb 10 reduces its degree of luminosity proportionally to the electrical resistance of the photocell.

The fully illuminated photocell has an electrical resistance of about 500 ohm, the lamp 10 in these circumstances is almost extinguished.

Placing a zener diode in series with the photocell F1 the point M of FIG. 8 is obtained. By varying the value of the zener diode selected the point M is displaced upwards or downwards. By varying the values of R3 and R4 the characteristic 13 of FIG. 8 is obtained.

The following are some values of the components of the electronic circuit;

L1=100 micro henry; L2-100 micro henry; C1 and C2-0.01 micro farad; C3-0.01 micro farad; C4-1 micro farad; R1-33 Kohm; R2-3.3 Kohm; R3=4.7 Kohm; R4=8.2 mega ohm; R5=22 kohm; G1-rectifier; T1=diac; T2=triac; F1=photocell.

The device is capable of being incorporated directly in a chandelier or in any holder or lamp holder at the time of their manufacture or mounted at any point of the circuit feeding the bulb always located in the space illuminated by the said bulb all this without departing from the scope of protection of the invention.

I claim:

1. An electronic device to save electric lighting energy, comprising a source of electric power, means to detect the ambient intensity of illumination, and means responsive to said detecting means to draw from said electric power source and to supply to an electric light power which is inversely proportional to the amount of light detected by said detecting means.

2. A device as claimed in claim 1, said drawing and supply means comprising a diac (T1), a triac (T2); a condenser (C3) fed by the drop in voltage at resistances (R1, R2 and R5); the condenser having a capacitance such as to reach a predetermined voltage of about 30 volts whereupon the diac (T1) connects the triac (T2) and the light (10) lights up; the whole being assembled so that varying the charge current of the said condenser (C3) advances or retards the ignition of the triac, which ignition may vary within 180 degrees, said detecting means being a photoelectric cell whose resistance varies inversely as the amount of ambient light it receives and which is in circuit with said condenser.

3. A device as claimed in claim 1, installed in a chandelier within a ceiling fixture of the chandelier.

4. A device as claimed in claim 1, embodied in an adapter capable of being screwed into a lamp holder.

5. A device as claimed in claim 1, mounted within a framework of a fluorescent lamp.

6. A device as claimed in claim 2, and a bundle of optical fibers connecting said photoelectric cell with a portion of the surroundings that is not directly illuminated by said electric light.

* * * * *